US006289633B1

(12) United States Patent
Lowe

(10) Patent No.: US 6,289,633 B1
(45) Date of Patent: Sep. 18, 2001

(54) PARKING PLACE OBSTRUCTION

(76) Inventor: Gwyn Lowe, 1430 S. Chestnut #102, Fresno, CA (US) 93702

( * ) Notice: Subject to any disclaimer, the term of this patent is extended or adjusted under 35 U.S.C. 154(b) by 0 days.

(21) Appl. No.: 09/523,441

(22) Filed: Mar. 10, 2000

(51) Int. Cl.[7] ..... E01F 13/00
(52) U.S. Cl. ..... 49/49
(58) Field of Search ..... 49/49, 35; 404/6, 404/9, 11

(56) References Cited

U.S. PATENT DOCUMENTS

| | | | | |
|---|---|---|---|---|
| 2,918,740 | | 12/1959 | Smith . | |
| 3,442,187 | | 5/1969 | Hausegger . | |
| 3,660,935 | * | 5/1972 | Boots | 49/49 X |
| 3,698,135 | * | 10/1972 | Boots et al. | 49/49 X |
| 4,062,149 | | 12/1977 | Collins . | |
| 4,919,563 | * | 4/1990 | Stice | 49/49 X |
| 5,054,237 | * | 10/1991 | Kapala et al. | 49/49 X |
| 5,070,646 | * | 12/1991 | Colombo | 49/49 |
| 5,309,674 | | 5/1994 | Weibel . | |
| 5,365,694 | * | 11/1994 | Macaluso | 49/49 |
| 5,365,695 | | 11/1994 | Kjellberg . | |
| 5,481,828 | * | 1/1996 | Kentrotas | 49/49 X |

* cited by examiner

*Primary Examiner*—Jerry Redman

(57) ABSTRACT

A parking place obstruction for obstructing egress or regress to or from a parking space. The parking place obstruction includes a cylindrical sleeve with an open top end and a bottom end. The sleeve is adapted for mounting in a ground surface. A cylindrical shaft is telescopically inserted in the sleeve. The shaft is telescopically positionable between an extended position and a retracted position with respect to the sleeve. A plurality of locking fins are extendible from the shaft. The locking fins rest on the open top end of the sleeve for holding the shaft in an extended position when the locking fins are in the deployed position. A locking elements locks the locking fins in the deployed position.

20 Claims, 3 Drawing Sheets

PARKING PLACE OBSTRUCTION

BACKGROUND OF THE INVENTION

1. Field of the Invention

The present invention relates to parking barriers and more particularly pertains to a new parking place obstruction for obstructing egress or regress to or from a parking space.

2. Description of the Prior Art

The use of parking barriers is known in the prior art. More specifically, parking barriers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,365,695; U.S. Pat. No. 5,309,674; U.S. Pat. No. 4,062,149; U.S. Pat. No. 3,442,187; U.S. Pat. No. 2,918,740; EPO Patent No. 0 571 305 A1 (Inventor: Pichon et al.); and EPO Patent No. 0 565 128 A1 (Inventor: Hormann).

While these devices fulfill their respective, particular objectives and requirements, the aforementioned patents do not disclose a new parking place obstruction. The inventive device includes a cylindrical sleeve with an open top end and a bottom end. The sleeve is adapted for mounting in a ground surface. A cylindrical shaft is telescopically inserted in the sleeve. The shaft is telescopically positionable between an extended position and a retracted position with respect to the sleeve. A plurality of locking fins are extendible from the shaft. The locking fins rest on the open top end of the sleeve for holding the shaft in an extended position when the locking fins are in the deployed position. A locking means locks the locking fins in the deployed position.

In these respects, the parking place obstruction according to the present invention substantially departs from the conventional concepts and designs of the prior art, and in so doing provides an apparatus primarily developed for the purpose of obstructing egress or regress to or from a parking space.

SUMMARY OF THE INVENTION

In view of the foregoing disadvantages inherent in the known types of parking barriers now present in the prior art, the present invention provides a new parking place obstruction construction wherein the same can be utilized for obstructing egress or regress to or from a parking space.

The general purpose of the present invention, which will be described subsequently in greater detail, is to provide a new parking place obstruction apparatus and method which has many of the advantages of the parking barriers mentioned heretofore and many novel features that result in a new parking place obstruction which is not anticipated, rendered obvious, suggested, or even implied by any of the prior art parking barriers, either alone or in any combination thereof.

To attain this, the present invention generally comprises a cylindrical sleeve with an open top end and a bottom end. The sleeve is adapted for mounting in a ground surface. A cylindrical shaft is telescopically inserted in the sleeve. The shaft is telescopically positionable between an extended position and a retracted position with respect to the sleeve. A plurality of locking fins are extendible from the shaft. The locking fins rest on the open top end of the sleeve for holding the shaft in an extended position when the locking fins are in the deployed position. A locking means locks the locking fins in the deployed position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new parking place obstruction apparatus and method which has many of the advantages of the parking barriers mentioned heretofore and many novel features that result in a new parking place obstruction which is not anticipated, rendered obvious, suggested, or even implied by any of the prior art parking barriers, either alone or in any combination thereof.

It is another object of the present invention to provide a new parking place obstruction which may be easily and efficiently manufactured and marketed.

It is a further object of the present invention to provide a new parking place obstruction which is of a durable and reliable construction.

An even further object of the present invention is to provide a new parking place obstruction which is susceptible of a low cost of manufacture with regard to both materials and labor, and which accordingly is then susceptible of low prices of sale to the consuming public, thereby making such parking place obstruction economically available to the buying public.

Still yet another object of the present invention is to provide a new parking place obstruction which provides in the apparatuses and methods of the prior art some of the advantages thereof, while simultaneously overcoming some of the disadvantages normally associated therewith.

Still another object of the present invention is to provide a new parking place obstruction for obstructing egress or regress to or from a parking space.

Yet another object of the present invention is to provide a new parking place obstruction which includes a cylindrical sleeve with an open top end and a bottom end. The sleeve is adapted for mounting in a ground surface. A cylindrical shaft is telescopically inserted in the sleeve. The shaft is telescopically positionable between an extended position and a retracted position with respect to the sleeve. A plurality of locking fins are extendible from the shaft. The locking fins rest on the open top end of the sleeve for holding the shaft in an extended position when the locking fins are in the deployed position. A locking means locks the locking fins in the deployed position.

Still yet another object of the present invention is to provide a new parking place obstruction that can also be used to block a vehicle in, preventing theft.

Even still another object of the present invention is to provide a new parking place obstruction that ensures that parking space is always available for the authorized driver.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
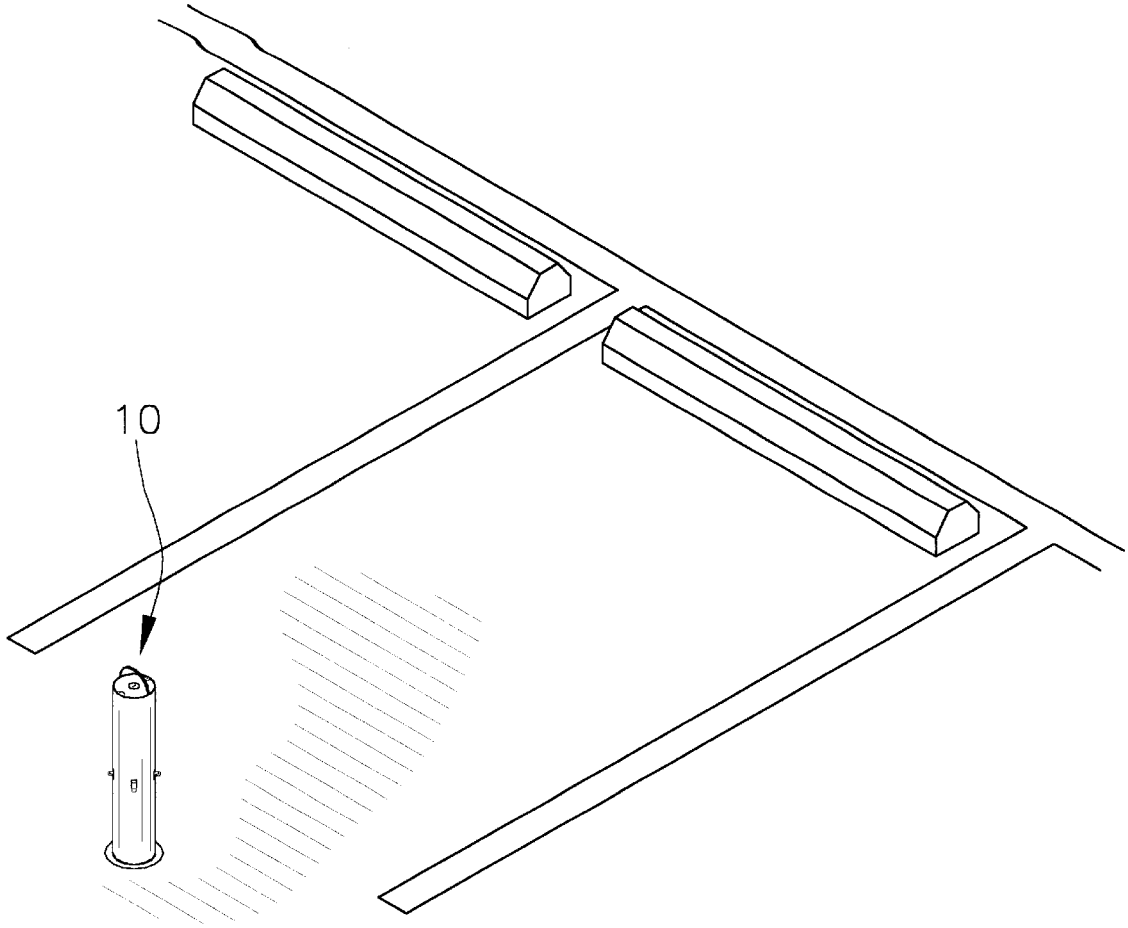
FIG. 1 is a schematic perspective view of a new parking place obstruction according to the present invention.
Figure 2:
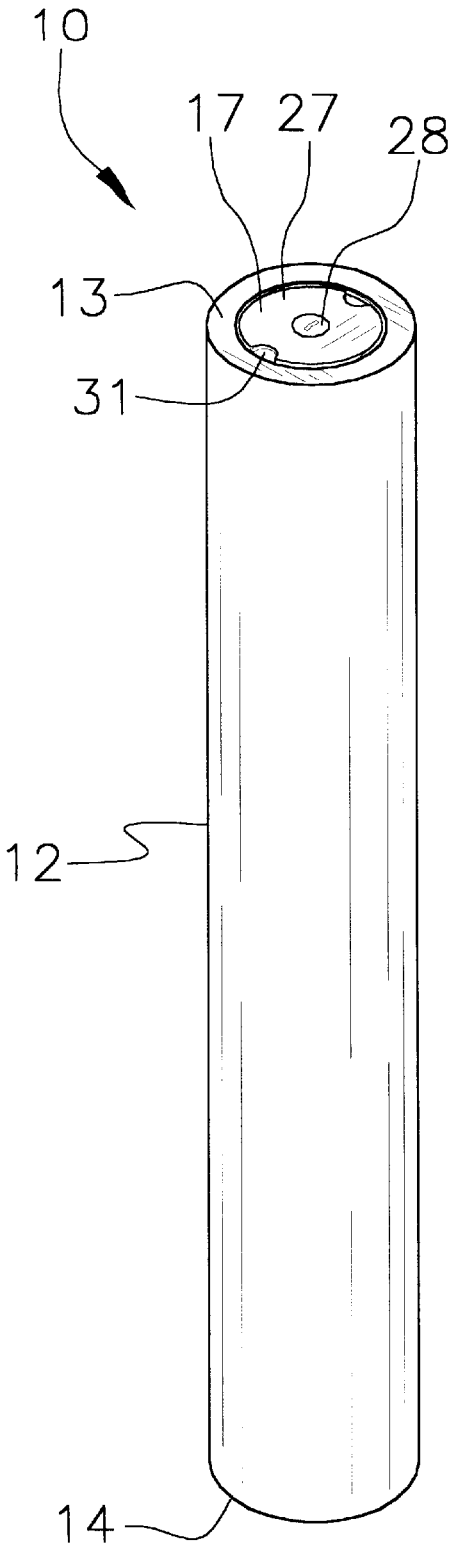
FIG. 2 is a schematic perspective view of the present invention in a retracted position.
Figure 3:
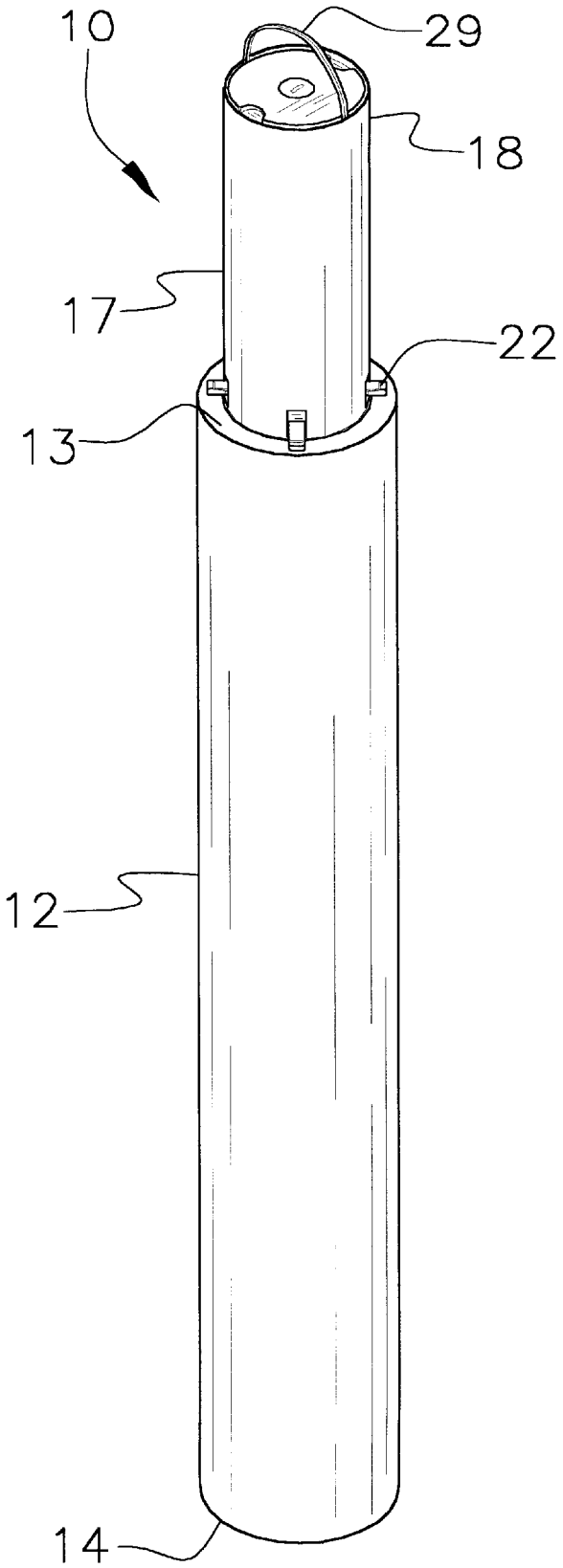
FIG. 3 is a schematic perspective view of the present invention in a partially deployed position.
Figure 4:
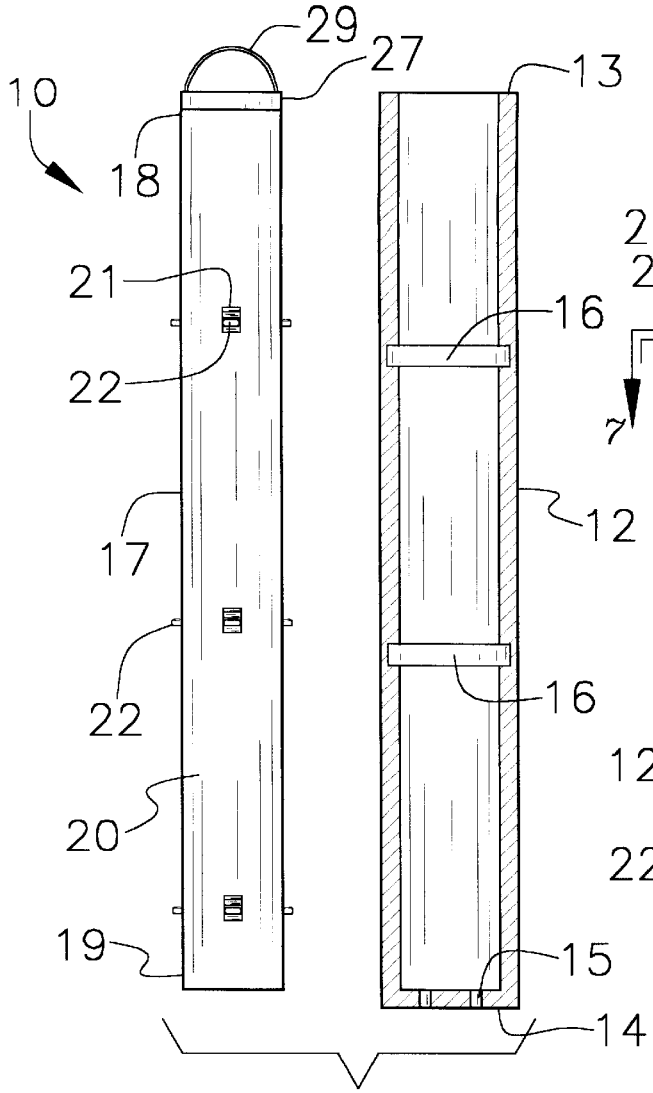
FIG. 4 is a schematic partial cross sectional exploded view of the present invention.

With reference now to the drawings, and in particular to FIGS. 1 through 8 thereof, a new parking place obstruction embodying the principles and concepts of the present invention and generally designated by the reference numeral 10 will be described.

As best illustrated in FIGS. 1 through 8, the parking place obstruction 10 generally comprises a cylindrical sleeve 12 with an open top end 13 and a bottom end 14. The sleeve is adapted for mounting in a ground surface such as in front of a parking space, as shown in FIG. 1. The sleeve may have a circular, square, or polygonal transverse cross section taken perpendicular to the longitudinal axis of the sleeve. Preferably, the top end is positioned substantially flush with the ground surface so that it will not cause damage to tires if run over. Also preferably, the bottom end has drainage apertures 15 through it so that rain water does not collect in the sleeve. A length of the sleeve is defined between its ends.

Preferably, the sleeve has a plurality of locking channels 16 extending around an inner surface thereof. Ideally, the sleeve has two locking channels extending around it. Most ideally, one of the locking channels is positioned about ⅓ of the length of the sleeve from the top end of the sleeve. The other of the locking channels is positioned about ⅓ of the length of the sleeve from the bottom end of the sleeve.

A cylindrical shaft 17 is telescopically inserted in the sleeve. The shaft has upper and lower ends 18, 19, a longitudinal axis extending between the ends, and a cylindrical sidewall 20 extending between the upper and lower ends. The shaft is telescopically positionable between an extended position, shown in FIG. 3, and a retracted position, shown in FIG. 2, with respect to the sleeve. The upper end of the shaft is spaced apart from the top end of the sleeve when the shaft is in the extended position. The upper end of the shaft is positioned adjacent the top end of the sleeve when the shaft is in the retracted position.

Preferably, the shaft has a plurality of sets of generally rectangular apertures 21 through its sidewall. Ideally, the apertures of a particular set of apertures are equally spaced and positioned radially about the shaft. Most ideally, each set of apertures has four apertures positioned at about 90 degree intervals about the shaft. Also ideally, the sidewall has three sets of apertures spaced apart along the longitudinal axis of the shaft. The spacing between adjacent sets of apertures should be equal to the spacing between adjacent locking channels.

The shaft has a plurality of generally rectangular locking fins 22 that are pivotally mounted in the apertures of the shaft. The locking fins are positionable between a deployed and a retracted position. The locking fins are oriented generally perpendicular to the longitudinal axis of the shaft when the locking fins are in the deployed position. The locking fins are generally aligned with the sidewall of the shaft when the locking fins are in the deployed position. The locking fins are inserted in the locking channels of the sleeve for holding the shaft in an extended position when the locking fins are in the deployed position.

Figure 5:
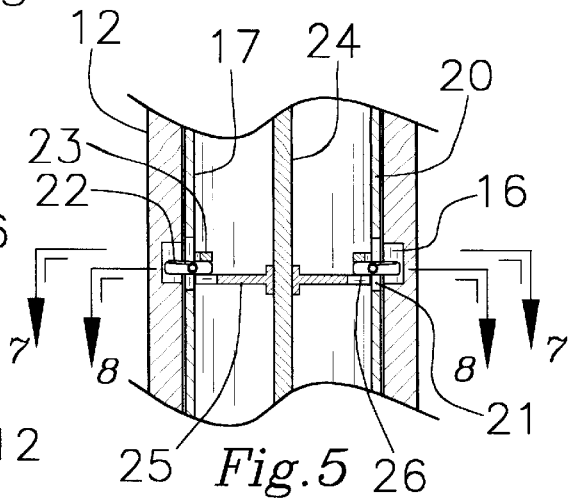
FIG. 5 is a schematic detailed cross sectional view of the present invention.

The shaft has a plurality of stop rings 23 extending from an inner surface thereof and positioned towards the apertures such that lower ends of the locking fins abut the stop rings when in the deployed position, as shown in FIG. 5. The stop rings prevent pivoting of the locking fins past the deployed position. The locking fins may also rest on the top end of the sleeve. The shaft is prevented from being removed by the lower sets of locking fins, which are locked in the locking channels.

A locking means locks the locking fins in place. Preferably, a locking rod 24 is rotatably positioned in the shaft and extends along the longitudinal axis of the shaft. The locking rod is rotatable between a locked position and an unlocked position. The locking rod has a plurality of locking plates 25 radially extending from it. The locking plates lock the locking fins in the deployed position by pinching the locking fins between the locking plates and stop rings when the locking rod is in the locked position. Each of the locking plates has a plurality of notches 26 therein adapted for permitting passage of the locking fins through the notch when the locking rod is positioned in the unlocked position.

Preferably, the locking fins are biased towards the deployed position such that upper ends of the locking fins pivot outwardly of the shaft when moving towards the deployed position. This causes the locking fins to spring out into the locking channels of the sleeve so that the locking plates may be rotated to lock the locking fins in place. The biasing also permits the locking plates to lock the locking fins in the retracted position.

Also preferably, the shaft has a cover 27 fixedly attached to it that has a lock mechanism 28 in communication with the locking rod. The lock mechanism permits rotation of the locking rod when a key (not shown) is inserted in the locking mechanism.

Preferably, the cover of the shaft has a handle 29 pivotally coupled to it and has a channel 30 extending along a peripheral edge of the cover adapted for receiving the handle therein. The handle permits raising and lowering of the shaft. The channel receives the handle so that it is flush with or below the upper surface of the cover so that the handle does not get run over. Ideally, the cover has a pair of finger channels 31 therein adapted for receiving a finger therein for facilitating extraction of the handle from the slot.

The preferred outer diameter of said shaft is about 4 inches. This provides the desired strength and high visibility while not being too heavy to lift. The preferred height of the shaft along its longitudinal axis is between about 3 and 5 feet, ideally about 4 feet. Again, this provides the desired high visibility.

Figure 6:
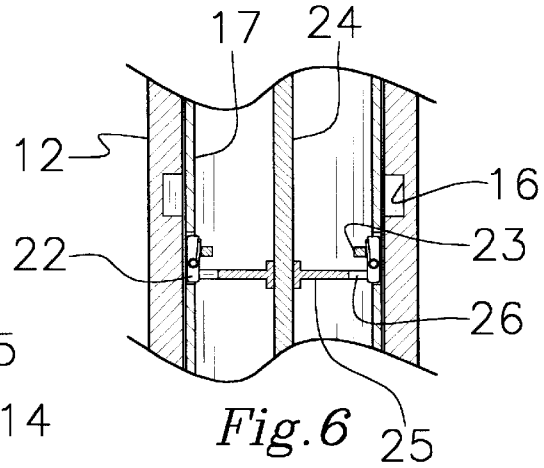
FIG. 6 is a schematic detailed cross sectional view of the present invention.
Figure 7:
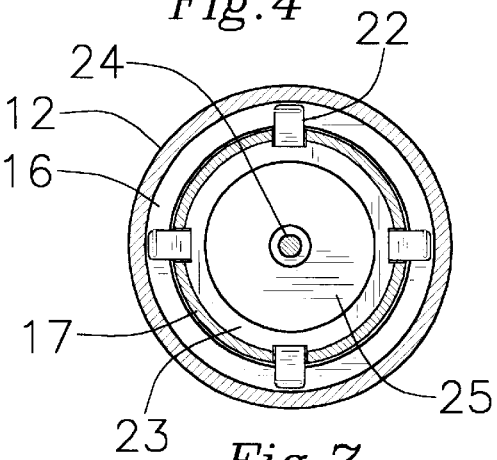
FIG. 7 is a schematic cross sectional view of the present invention taken from line 7—7 of FIG. 5.
Figure 8:
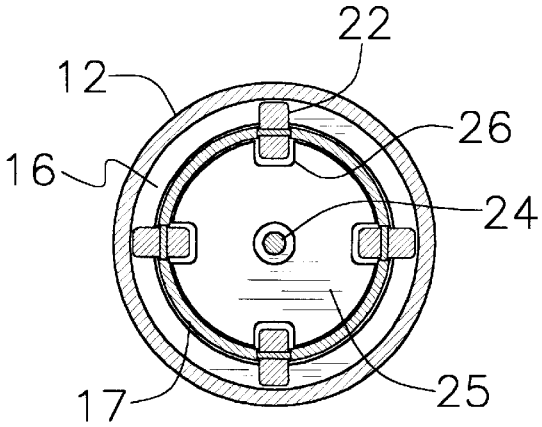
FIG. 8 is a schematic cross sectional view of the present invention taken from line 8—8 of FIG. 5.

In use, as shown in FIG. 6, the locking fins are positioned in the retracted position when the locking fins are not aligned with the locking channels of the sleeve. The locking rod is rotated such that the locking fins are locked in the retracted position by the locking plates. The shaft is pulled upwardly to the minimum desired height. The locking rod is rotated to position the notches of the locking plates towards the locking fins such that the locking fins may rotate through the notches. The shaft is pulled up until the locking fins swing into the locking channels and stop the upward movement of the shaft. The locking rod is rotated to position the notches of the locking plates away from the locking fins such that the locking fins are pinned between the stop rings and the locking plates. The shaft is now locked in this position.

To lower the shaft, the locking rod is rotated to position the notches of the locking plates towards the locking fins such that the locking fins may rotate through the notches. The shaft is lowered into the sleeve.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An obstruction device for preventing passage of vehicles, said device comprising:

a cylindrical sleeve having an open top end and a bottom end, said sleeve being adapted for mounting in a ground surface;

a cylindrical shaft being telescopically inserted in said sleeve, said shaft having upper and lower ends, a longitudinal axis extending between said ends, and a cylindrical sidewall extending between said upper and lower ends;

said shaft being telescopically positionable between an extended position and a retracted position with respect to said sleeve, said upper end of said shaft being spaced apart from said top end of said sleeve when said shaft is in said extended position, said upper end of said shaft being positioned adjacent said top end of said sleeve when said shaft is in said retracted position;

said shaft having a plurality of locking fins being extendible therefrom, said locking fins being restable on said open top end of said sleeve for holding said shaft in an extended position when said locking fins are in said deployed position;

a locking means for locking said locking fins in said deployed position; and wherein said shaft has a set of generally rectangular apertures through said sidewall thereof, said locking fins being pivotally mounted in said apertures.

2. The obstruction device of claim 1, wherein said top end of said sleeve is positioned substantially flush with said ground surface.

3. The obstruction device of claim 1, wherein said sleeve has a locking channel extending around an inner surface thereof, said locking fins being insertable in said locking channel of said sleeve for holding said shaft in an extended position when said locking fins are in said deployed position.

4. The obstruction device of claim 1, wherein said locking fins are biased towards said deployed position such that upper ends of said locking fins pivot outwardly of said shaft when moving towards said deployed position.

5. The obstruction device of claim 1, wherein said shaft has a stop ring extending from an inner surface thereof and positioned towards said apertures such that lower ends of said locking fins abut said stop ring when in said deployed position.

6. The obstruction device of claim 1, wherein said locking means comprises a locking rod rotatably positioned in said shaft and extending along said longitudinal axis of said shaft, said locking rod being rotatable between a locked position and an unlocked position, said locking rod having a locking plate radially extending therefrom, said locking plate being for locking said locking fins in said deployed position when said locking rod is in said locked position.

7. The obstruction device of claim 1, wherein said locking means comprises a locking rod rotatably positioned in said shaft and extending along said longitudinal axis of said shaft, said locking rod being rotatable between a locked position and an unlocked position, said locking rod having a locking plate radially extending therefrom, said locking plate being for locking said locking fins in said deployed position when said locking rod is in said locked position.

8. The obstruction device of claim 7, wherein each of said locking plates has a plurality of notches therein adapted for permitting passage of said locking fins therethrough when said locking rod is positioned in said unlocked position.

9. The obstruction device of claim 7, wherein said shaft has a cover being fixedly attached thereto, said cover having a lock mechanism in communication to said locking rod, said lock mechanism permitting rotation of said locking rod when a key is inserted in said locking mechanism.

10. The obstruction device of claim 9, wherein said cover of said shaft has a handle pivotally coupled thereto and a channel extending along a peripheral edge of said cover adapted for receiving said handle therein.

11. The obstruction device of claim 10, wherein said cover has a pair of finger channels therein adapted for receiving a finger therein for facilitating extraction of said handle from said slot.

12. An obstruction device for preventing passage of vehicles, said device comprising:

a cylindrical sleeve having an open top end and a bottom end, said sleeve being adapted for mounting in a ground surface;

said top end being positioned substantially flush with said ground surface;

said sleeve having a plurality of locking channels extending around an inner surface thereof;

wherein said sleeve has two locking channels extending therearound;

a length of said sleeve being defined between said ends thereof;

wherein one of said locking channels is positioned about ⅓ of said length of said sleeve from said top end of said sleeve, wherein the other of said locking channels is positioned about ⅓ of said length of said sleeve from said bottom end of said sleeve;

a cylindrical shaft being telescopically inserted in said sleeve, said shaft having upper and lower ends, a longitudinal axis extending between said ends, and a cylindrical sidewall extending between said upper and lower ends;

said shaft being telescopically positionable between an extended position and a retracted position with respect to said sleeve, said upper end of said shaft being spaced apart from said top end of said sleeve when said shaft is in said extended position, said upper end of said shaft being positioned adjacent said top end of said sleeve when said shaft is in said retracted position;

said shaft having a plurality of sets of generally rectangular apertures through said sidewall thereof;

wherein said apertures of a set of apertures are equally spaced and positioned radially about said shaft;

wherein each set of apertures has four apertures positioned at about 90 degree intervals about said shaft;

wherein said sidewall has three sets of apertures being spaced apart along said longitudinal axis of said shaft;

said shaft having a plurality of locking fins being pivotally mounted in said apertures thereof, said fins being positionable between a deployed and a retracted position, said locking fins being oriented generally perpendicular to said longitudinal axis of said shaft when said locking fins are in said deployed position, said locking fins being generally aligned with said sidewall of said shaft when said locking fins are in said deployed position;

said locking fins being inserted in said locking channels of said sleeve for holding said shaft in an extended position when said locking fins are in said deployed position;

said shaft having a plurality of stop rings extending from an inner surface thereof and positioned towards said apertures such that lower ends of said locking fins abut said stop rings when in said deployed position, said stop rings being for preventing pivoting of said locking fins past said deployed position;

a locking rod rotatably positioned in said shaft and extending along said longitudinal axis of said shaft;

said locking rod being rotatable between a locked position and an unlocked position;

said locking rod having a plurality of locking plates radially extending therefrom, said locking plates being for locking said locking fins in said deployed position when said locking rod is in said locked position;

each of said locking plates having a plurality of notches therein adapted for permitting passage of said locking fins therethrough when said locking rod is positioned in said unlocked position;

said locking fins being biased towards said deployed position such that upper ends of said locking fins pivot outwardly of said shaft when moving towards said deployed position;

said shaft having a cover being fixedly attached thereto, said cover having a lock mechanism in communication to said locking rod, said lock mechanism permitting rotation of said locking rod when a key is inserted in said locking mechanism;

said cover of said shaft having a handle pivotally coupled thereto and a channel extending along a peripheral edge of said cover adapted for receiving said handle therein; and said cover having a pair of finger channels therein adapted for receiving a finger therein for facilitating extraction of said handle from said slot.

13. An obstruction device for preventing passage of vehicles, said device comprising:

a cylindrical sleeve having an open top end and a bottom end, said sleeve being adapted for mounting in a ground surface;

a cylindrical shaft being telescopically inserted in said sleeve, said shaft having upper and lower ends, a longitudinal axis extending between said ends, and a cylindrical sidewall extending between said upper and lower ends;

said shaft being telescopically positionable between an extended position and a retracted position with respect to said sleeve, said upper end of said shaft being spaced apart from said top end of said sleeve when said shaft is in said extended position, said upper end of said shaft being positioned adjacent said top end of said sleeve when said shaft is in said retracted position;

said shaft having a plurality of locking fins being extendible therefrom, said locking fins being restable on said open top end of said sleeve for holding said shaft in an extended position when said locking fins are in said deployed position;

a locking means for locking said locking fins in said deployed position; and wherein said shaft has a set of apertures through said sidewall thereof, said locking fins being pivotally mounted in said apertures.

14. The obstruction device of claim 13, wherein said top end of said sleeve is positioned substantially flush with said ground surface.

15. The obstruction device of claim 13, wherein said sleeve has a locking channel extending around an inner surface thereof, said locking fins being insertable in said locking channel of said sleeve for holding said shaft in an extended position when said locking fins are in said deployed position.

16. The obstruction device of claim 13, wherein said locking fins are biased towards said deployed position such that upper ends of said locking fins pivot outwardly of said shaft when moving towards said deployed position.

17. The obstruction device of claim 13, wherein said shaft has a stop ring extending from an inner surface thereof and positioned towards said apertures such that lower ends of said locking fins abut said stop ring when in said deployed position.

18. The obstruction device of claim 13, wherein said locking means comprises a locking rod rotatably positioned in said shaft and extending along said longitudinal axis of said shaft, said locking rod being rotatable between a locked position and an unlocked position, said locking rod having a locking plate radially extending therefrom, said locking plate being for locking said locking fins in said deployed position when said locking rod is in said locked position.

19. The obstruction device of claim 13, wherein said locking means comprises a locking rod rotatably positioned in said shaft and extending along said longitudinal axis of said shaft, said locking rod being rotatable between a locked position and an unlocked position, said locking rod having a locking plate radially extending therefrom, said locking plate being for locking said locking fins in said deployed position when said locking rod is in said locked position.

20. The obstruction device of claim 19, wherein each of said locking plates has a plurality of notches therein adapted for permitting passage of said locking fins therethrough when said locking rod is positioned in said unlocked position.

* * * * *